US011005238B1

(12) United States Patent
Shibata

(10) Patent No.: US 11,005,238 B1
(45) Date of Patent: May 11, 2021

(54) SPARK PLUG

(71) Applicant: DENSO CORPORATION, Kariya (JP)

(72) Inventor: Masamichi Shibata, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/953,488

(22) Filed: Nov. 20, 2020

(30) Foreign Application Priority Data

Nov. 21, 2019 (JP) ..... JP2019-210759

(51) Int. Cl.
*H01T 13/36* (2006.01)
*H01T 13/32* (2006.01)

(52) U.S. Cl.
CPC ..... *H01T 13/36* (2013.01); *H01T 13/32* (2013.01)

(58) Field of Classification Search
CPC ..... H01T 13/36; H01T 13/32
See application file for complete search history.

(56) References Cited

U.S. PATENT DOCUMENTS

2002/0041137 A1 4/2002 Nishikawa et al.
2013/0015756 A1* 1/2013 Yamada ..... H01T 13/36 313/143
2015/0188294 A1* 7/2015 Nishida ..... H01B 3/12 174/110 R
2015/0295388 A1* 10/2015 Kobayashi ..... H01T 13/16 313/143

FOREIGN PATENT DOCUMENTS

JP 50-59428 6/1975
JP 2014-107084 6/2014

* cited by examiner

*Primary Examiner* — Kevin Quarterman
(74) *Attorney, Agent, or Firm* — Nixon & Vanderhye P.C.

(57) ABSTRACT

A spark plug has a housing, an insulator, a central electrode and a ground electrode. A projection part is formed projecting radially from the housing. The spark plug has a structure which satisfies a relationship of $t2/t1 \leq 0.85$, $s1 \leq 0.5$, and $s1 \geq 1.05 - t2/t1$. A leg part of the insulator has a first end and a second end in an axial direction thereof. The second end is located opposite to the first end in the axial direction. In the relationship, t1 represents a first radial thickness of the first end in a radial direction of the leg part, t2 represents a center radial thickness in the radial direction at a middle position of the leg part, and s1 represents a first gap width in the radial direction of the housing between the projection part of the housing and the first end of the leg part.

20 Claims, 5 Drawing Sheets

FIG.5

| TEST SAMPLES | No | s1 | t1 | t2 | t2/t1 | F/O RESISTANCE | POLLUTION RESISTANCE | DRIVABILITY |
|---|---|---|---|---|---|---|---|---|
| 1 | COMPARATIVE EXAMPLE | 0.25 | 1.71 | 1.20 | 0.70 | B | A | A |
| 2 | COMPARATIVE EXAMPLE | 0.25 | 1.71 | 1.28 | 0.75 | B | A | A |
| 3 | COMPARATIVE EXAMPLE | 0.10 | 1.71 | 1.54 | 0.90 | B | A | B |
| 4 | COMPARATIVE EXAMPLE | 0.15 | 1.71 | 1.54 | 0.90 | A | A | B |
| 5 | COMPARATIVE EXAMPLE | 0.15 | 1.71 | 1.45 | 0.85 | B | A | A |
| 6 | EXEMPLARY EMBODIMENT | 0.20 | 1.71 | 1.45 | 0.85 | A | A | A |
| 7 | EXEMPLARY EMBODIMENT | 0.30 | 1.71 | 1.28 | 0.75 | A | A | A |
| 8 | EXEMPLARY EMBODIMENT | 0.35 | 1.71 | 1.37 | 0.80 | A | A | A |
| 9 | COMPARATIVE EXAMPLE | 0.35 | 1.71 | 1.11 | 0.65 | B | A | A |
| 10 | EXEMPLARY EMBODIMENT | 0.40 | 1.71 | 1.11 | 0.65 | A | A | A |
| 11 | EXEMPLARY EMBODIMENT | 0.50 | 1.71 | 1.11 | 0.65 | A | A | A |
| 12 | COMPARATIVE EXAMPLE | 0.55 | 1.71 | 1.11 | 0.65 | A | B | A |
| 13 | EXEMPLARY EMBODIMENT | 0.50 | 1.71 | 1.45 | 0.85 | A | A | A |
| 14 | COMPARATIVE EXAMPLE | 0.55 | 1.71 | 1.45 | 0.85 | A | B | A |
| 15 | COMPARATIVE EXAMPLE | 0.50 | 1.71 | 1.54 | 0.90 | A | A | B |
| 16 | EXEMPLARY EMBODIMENT | 0.50 | 1.71 | 1.28 | 0.75 | A | A | A |
| 17 | COMPARATIVE EXAMPLE | 0.55 | 1.71 | 1.28 | 0.75 | A | B | A |
| 18 | EXEMPLARY EMBODIMENT | 0.40 | 1.71 | 1.50 | 0.80 | A | A | A |
| 19 | COMPARATIVE EXAMPLE | 0.40 | 1.71 | 1.50 | 0.90 | A | A | B |

SPARK PLUG

CROSS-REFERENCE TO RELATED APPLICATION

This application is related to and claims priority from Japanese Patent Application No. 2019-210759 filed on Nov. 21, 2019, the contents of which are hereby incorporated by reference.

TECHNICAL FIELD

The present disclosure relates to spark plugs.

BACKGROUND

There has been a known spark plug has an insulator, a central electrode and a metal fitting. An axial through hole is formed along an axial direction of the insulator. The central electrode is arranged at a distal end side of the axial through hole of the insulator. The metal fitting is arranged at an outer periphery of the insulator so as to support the insulator in the spark plug. For example, there is a known spark plug having the structure previously described. That is, the insulator in the spark plug has a degree of outer surface roughness. An average calculation roughness Ra of the outer surface roughness is within a range of not less than 3 μm and not larger than 15 μm. This structure suppresses a flashover phenomenon from occurring due to a roughness on the outer surface of the insulator when the average calculation roughness Ra of the outer surface of the outer surface is not less than 3 μm. Further, this structure suppresses damage and cracks from occurring in the insulator when the average calculation roughness Ra of the outer surface of the outer surface is not larger than 15 μm because of reducing a stress applied to the recess part on the outer surface of the insulator.

However, the structure of the spark plug having the known structure previously described reduces a productivity of producing the spark plug because of being required to perform precise control of the outer surface roughness degree of the insulator.

SUMMARY

It is desired for the present disclosure to provide a spark plug having a metal fitting or a housing, an insulator, a central electrode and a ground electrode. The metal fitting has a cylindrical shape. The metal fitting has a projection part of a ring shape. The metal fitting projects radially. The insulator has a cylindrical shape and is inserted into and fitted to an inside of the metal fitting. The insulator has a first body part, a second body part and a leg part. The second body part has a second outer diameter which is greater than an inner diameter of the projection part. The first body part has a first outer diameter which is greater than the second outer diameter of the second body part. The leg part has a third outer diameter which is smaller than the inner diameter of the projection part. A gap formed between a step part and the leg part is sealed with a packing. The step part is formed between the second body part and the leg part of the insulator. The central electrode projects from an inside of the insulator. The ground electrode is joined to the metal fitting and has an extension part, a curved part and a flat part. The extension part is joined to the flat part through the curved part to face a distal end surface of the central electrode. The spark plug satisfies a relationship of $t2/t1 \leq 0.85$, and $s1 \leq 0.5$, and $s1 \geq 1.05 - t2/t1$, where the leg part has a first end and a second end in the axial direction of the leg part, the first end of the leg part is located at the end of the second body part of the insulator. In the relationship, the second end is located opposite to the first end in the axial direction of the leg part, t1 represents a first radial thickness of the first end, t2 represents a center radial thickness in the radial direction of the leg part at a middle position between the first end and the second end. In the relationship, s1 represents a first gap width of a gap between the projection part of the metal fitting and the first end of the leg part in a radial direction of the metal fitting.

BRIEF DESCRIPTION OF THE DRAWINGS

A preferred, non-limiting embodiment of the present disclosure will be described by way of example with reference to the accompanying drawings, in which:

FIG. 5 is a table showing experimental results of a first gap width s1, a first radial thickness t, a center radial thickness t2, a ratio t1/t2 and evaluation results of test samples 6-8, 10-11, 13, 16 and 17 and comparative samples 1-5, 9, 12, 14-15, 17 and 19.

DETAILED DESCRIPTION OF THE PREFERRED EMBODIMENTS

Figure 1:
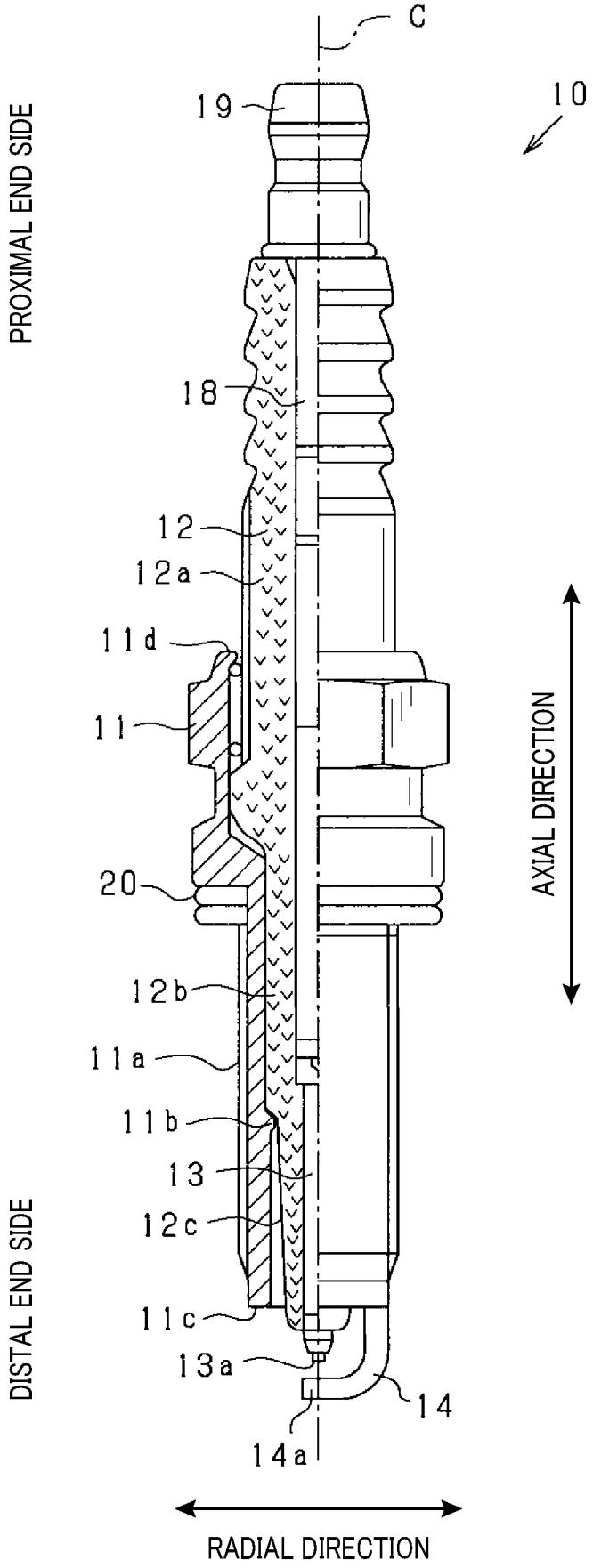
FIG. 1 is a view showing a half cross section of a spark plug 10 according to an exemplary embodiment of the present disclosure.

Hereinafter, various embodiments of the present disclosure will be described with reference to the accompanying drawings. In the following description of the various embodiments, like reference characters or numerals designate like or equivalent component parts throughout the several diagrams.

EXEMPLARY EMBODIMENT

A description will be given of a spark plug 10 according to an exemplary embodiment of the present disclosure with reference to FIG. 1 to FIG. 6.

FIG. 1 is a view showing a half cross section of the spark plug 10 according to the exemplary embodiment of the present disclosure. As shown in FIG. 1, the spark plug 10 has a housing 11 has a housing 11, an insulator 13, a central electrode 13 and a ground electrode 14.

The housing 11 is a metal fitting made of metal member such as iron steel, etc. The housing 11 has a cylindrical shape. A screw part 11*a* is formed on the outer peripheral surface at the proximal end side of the housing 11. The housing 11 is also referred to as the main metal fitting.

The screw part 11*a* has an outer diameter of 10 mm. The housing 11 has a projection part 11*b* of a ring shape. The projection part 11*b* projects radially.

Figure 2:
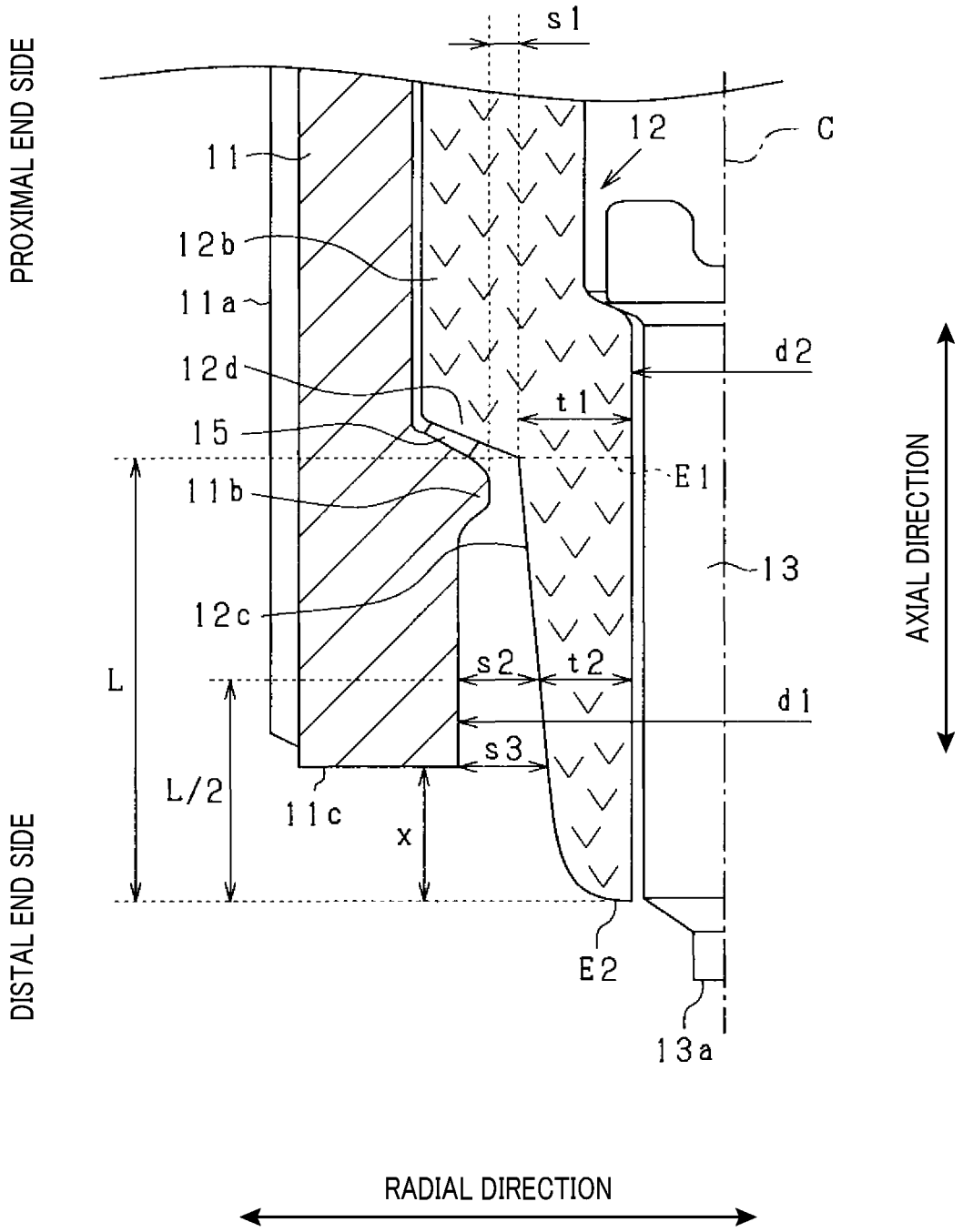
FIG. 2 is an enlarged view of the spark plug shown in FIG. 1.

FIG. 2 is an enlarged view of the spark plug shown in FIG. 1. As clearly shown in FIG. 2, the projection part 11*b* of a ring shape projects radially.

The proximal end part of the insulator 12 is inserted and fitted to the inside of the housing 11 so as to be coaxially arranged in the inside of the housing 11. The insulator 12 is made of insulation material such as alumina, etc. The insulator 12 has a first body part 12*a*, a second body part 12*b* and a leg part 12*c*. The first body part 12*a* has a first outer diameter which is greater than a second outer diameter of the second body part 12*b*. The second body part 12*b* has the second outer diameter which is greater than a third outer diameter of the leg part 12*c*. As shown in FIG. 2, the second body part 12*b* has the second outer diameter which is greater than an inner diameter of the projection part 11*b*.

The leg part 12*c* has the third outer diameter which is smaller than the inner diameter of the projection part 11*b* of the housing 11.

A step part 12*d* of a ring shape is formed between the second body part 12*b* and the leg part 12*c*. A gap formed between the step part 12*d* of the insulator 12 and the projection part 11*b* of the housing 11 is sealed with a packing 15 having a ring shape. The upper end part 11*d* of the housing 11 is caulked so as to connect the housing 11 with the insulator 12 together to a single body.

As shown in FIG. 2, the central electrode 13 is inserted into and supported by the inside of the leg part 12*c* of the insulator 12. The central electrode 13 has a column shape and is made of a nickel (Ni) based alloy. Specifically, the central electrode 13 is made of a central material. The central material is made of copper and an outer material made of a Ni based alloy. The distal end side of the central electrode 13 projects from the bottom end side of the insulator 12.

As shown in FIG. 1, the ground electrode 14 is joined to the metal fitting. The ground electrode 14 has an extension part, a curved part and a flat part. In the ground electrode 14, the extension part is joined to the flat part through the curved part. The extension part of the ground electrode 14 is formed extending from a distal end surface 11*c* of the housing 11. The extension part of the ground electrode 14 is arranged in the axial direction of the spark plug 10, and the flat part of the ground electrode 14 is arranged in the radial direction of the spark plug 10. The central electrode 13 and the ground electrode 14 are arranged such that a distal end surface 13*a* of the central electrode 13 faces the flat part of the ground electrode 14.

The ground electrode 14 is joined to the housing 11, and extends from the housing 11 to face the distal end surface 13*a* of the central electrode 13. Similar to the central electrode 13, the ground electrode 14 is made of a Ni based alloy.

A spark gap is formed between the distal end surface 13*a* of the central electrode 13 and a distal end part 14*a* of the ground electrode 14. A spark discharge occurs in the spark gap formed between the distal end surface 13*a* of the central electrode 13 and the distal end part 14*a* of the ground electrode 14.

Further, as known, the spark plug 10 has a central axis part 18 and a terminal part 19 which is electrically joined to the upper side of the central electrode 13. An external circuit (not shown) is connected to the terminal part 19 of the spark plug 10 so as to supply a high voltage between the central electrode 13 When a high voltage is supplied to the central electrode 13, a spark discharge occurs in the spark gap formed between the distal end surface 13*a* of the central electrode 13 and the distal end part 14*a* of the ground electrode 14. Further, a gasket 20 is arranged at the upper end side of the screw part 11*a* of the housing 11 so as for the spark plug 10 to be mounted to an internal combustion engine (not shown).

When the spark plug 10 is mounted to a combustion chamber of an internal combustion engine, the central electrode 13 and the ground electrode 14 of the spark plug 10 are exposed to a mixture gas introduced into the combustion chamber of the internal combustion engine. A direction of the central electrode 13 to the ground electrode 14 is equal to a direction towards the center of the combustion chamber of the internal combustion engine.

A description will be given of a detailed structure of the distal end part of the housing 11 and the leg part 12*c* of the insulator 12.

The spark plug 10 according to the exemplary embodiment of the present disclosure has an improved structure in which the portion of the housing 11 except for the projection part 11*b*, which faces the leg part 12*c* of the insulator 12, has an inner diameter d1 of 6.0 mm. The leg part 12*c* has an inner diameter d2 of 1.75 mm. In the axial direction of the leg part 12*c* of the insulator 12 (which coincides with the central axial direction C of the spark plug 10), the leg part 12*c* has a projection part projected from the housing 11. The projection part of the leg part 12 has a projection length x of 1.5 mm.

The leg part 12*c* of the insulator 12 has a first end E1 at the second body part 12*b* side and a second end E2 at the opposite side of the second body part 12*b*. The leg part 12*c* has a leg length L of 14 mm, which corresponds to a length between the first end E1 and the second end E2 in the axial direction of the leg part 12*c*.

On a cross section of the spark plug 10 along the central axial line C of the spark plug 10, the first end E1 corresponds to a cross point between a straight line along the surface of the leg part 12*c* and a straight line along the step part 12*d* of a ring shape when the leg part 12*c* is joined to the step part 12*d* of the insulator 12 at an angle of larger than 90°, not less than 90°.

The first end E1 in a radial direction of the leg part 12*c* has the first radial thickness t1 of 1.71 mm. A middle part of the leg part 12*c* between the first end E1 and the second end E2 has a center radial thickness t2 (mm) within a range of 1.11 mm to 1.54 mm.

An experiment was performed on the exemplary embodiment, which will be explained later. The experiment on the exemplary embodiment evaluated the ignitability performance of the test samples having the center radial thickness t2 (mm) within the range of 1.11 mm to 1.54 mm. This range of the center radial thickness t2 (mm) varies a ratio t2/t1 within a range of 0.65 to 0.90, which will be explained later.

The spark plug 10 according to the exemplary embodiment of the present disclosure has the improved structure in which the gap in the radial direction between the projection part 11*b* of the housing 11 and the first end E1 of the leg part 12*c* of the insulator 12 has a first gap width s1 (mm).

The experiment according to the exemplary embodiment evaluated the ignitability performance of the test samples having the first gap width s1 within the range of 0.10 mm to 0.55 mm. This range of the first gap width s1 is adjusted by varying the projection length of the projection part 11*b* radially in the radial direction (see FIG. 2 and FIG. 3).

The spark plug 10 according to the exemplary embodiment of the present disclosure has the improved structure in which the gap in the radial direction between the housing 11 and the middle position in the axial direction of the leg part 12*c* has a second gap width s2 (mm). The second gap width s2 varies due to the variation of the center radial thickness t2. In the axial direction of the leg part 12*c*, the length from the second end E2 (see FIG. 2) to the middle part of the leg part 12*c* is represented by L/2 which is half of the total length L in the axial direction of the leg part 12*c* of the insulator 12.

Further, the spark plug 10 according to the exemplary embodiment of the present disclosure has the improved structure in which the gap in the radial direction between the housing 11 and the second end E2 of the leg part 12*c* has a third gap width s3 (mm). The spark plug 10 according to the exemplary embodiment satisfies the relationship of s1<s2<s3. That is, as shown in FIG. 2, the leg part 12*c* of the insulator 12 has a tapered cylindrical shape.

Figure 3:
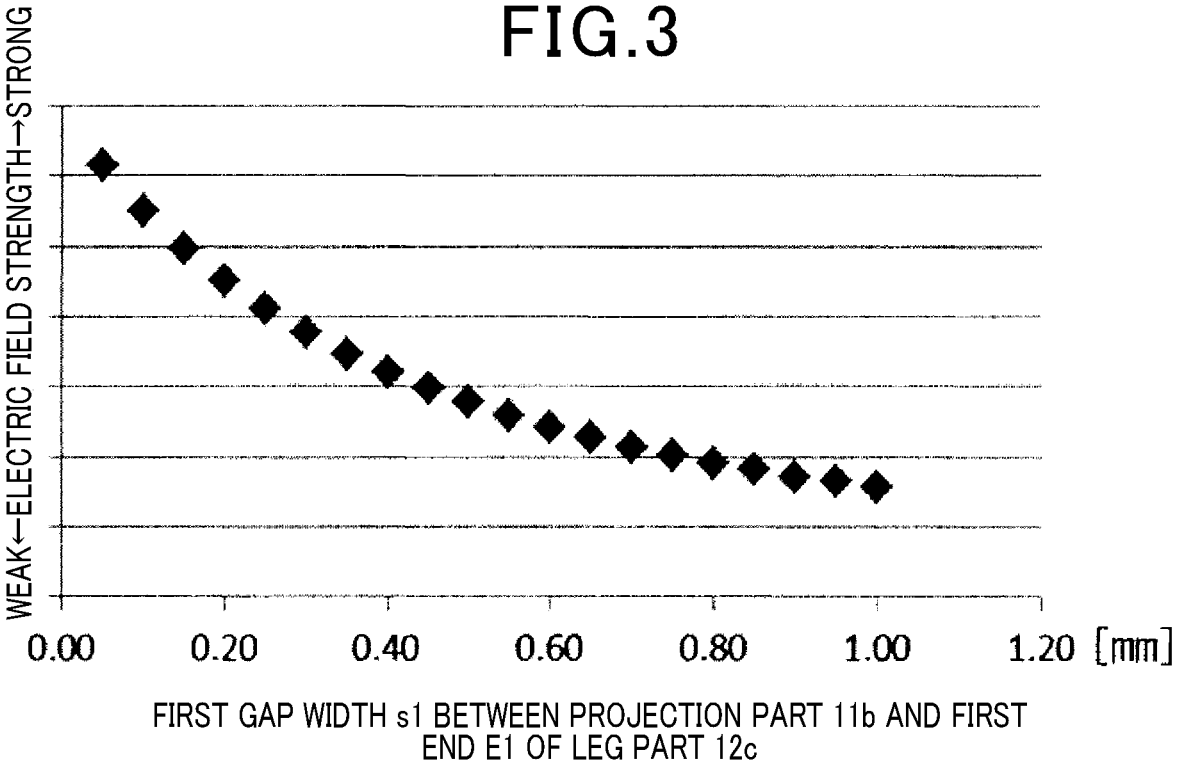
FIG. 3 is a graph showing a relationship between a first gap width s1 shown in FIG. 2 and an electric field strength between a projection part 11*b* and a first end E1 of a leg part 12*c* in the spark plug shown in FIG. 1.

FIG. 3 is a graph showing a relationship between the first gap width s1 shown in FIG. 2 and an electric field strength between the projection part 11*b* and the first end E1 of the leg part 12*c* in the spark plug 10 according to the exemplary embodiment shown in FIG. 1.

As clearly shown from the experimental results in FIG. 3, the shorter the first gap width s1 is, the stronger the electrical field strength between the projection part 11*b* and the first end E1 of the leg part 12*c* becomes.

As has been explained, the first gap width s1 represents the width of the gap measured in the radial direction between the projection part 11*b* of the housing 11 and the first end E1 of the leg part 12*c* of the insulator 12. That is, the stronger the electric field strength in a gap is, the more a fuel mixture gas in the gap is easily ionized. Ionization of the fuel mixture gas in the combustion chamber of an internal combustion engine allows a streamer discharge phenomenon to easily occur.

Figure 4:
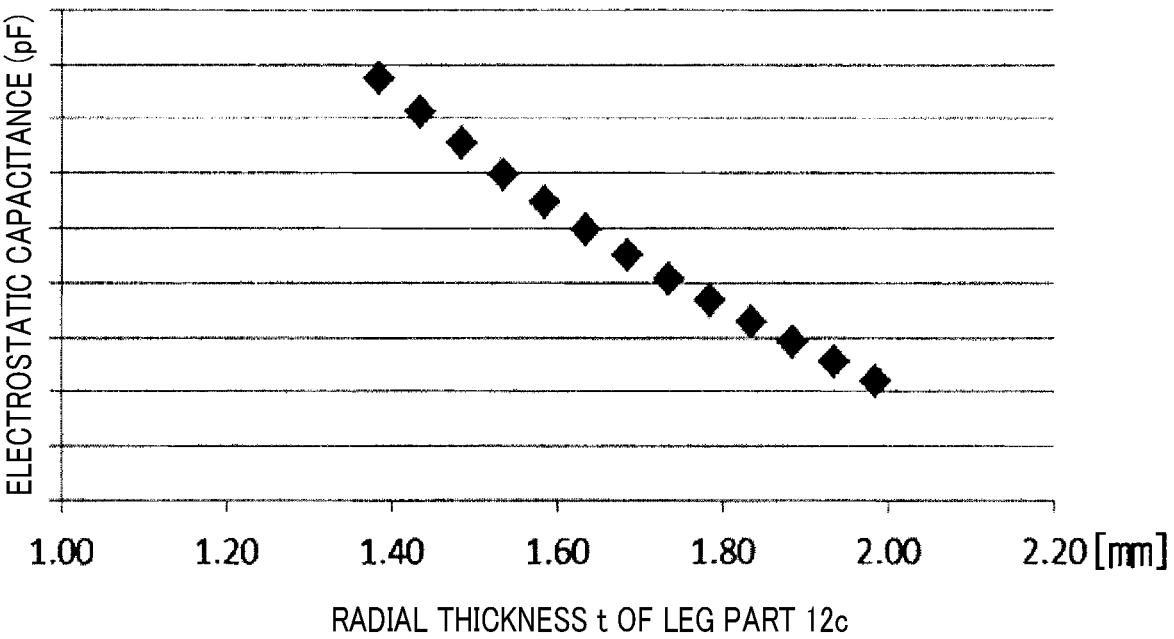
FIG. 4 is a graph showing a relationship between a radial thickness t (t1~t2) of the leg part 12*c* and an electrostatic capacitance (pF) of the leg part 12*c* in the spark plug 10 shown in FIG. 1.

FIG. 4 is a graph showing a relationship between the radial thickness t (t1~t2) of the leg part 12*c* and an electrostatic capacitance (pF) of the leg part 12*c* in the spark plug shown in FIG. 1. In the experimental results shown in FIG. 4, the overall leg part 12 has a constant radial diameter. The radial thickness t of the leg part 12*c*, i.e. the thickness in the radial direction of the leg part 12*c* of the insulator 12 is a constant value along the axial direction of the spark plug 10. As clearly shown in FIG. 4, the thinner the radial thickness t of the leg part 12*c* is, the more such a streamer discharge phenomenon easily occurs and progresses because of increasing the electrostatic capacitance (pF) of the leg part 12*c*.

Further, a spark discharge easily occurs in a gap between the housing 11 and the central electrode 13 through carbon accumulated on the leg part 12*c* of the insulator 12 according to increasing of the center radial thickness t2 of the leg part 12*c* which is a thickness in the radial direction at the middle part of the leg part 12 between the first end E1 and the second end E2. This prevents correct discharge between the ground electrode 14 and the central electrode 13 from occurs in the park gap, and reduces the ignitability of a fuel mixture gas in the combustion chamber of an internal combustion engine.

Still further, if the first gap width s1 becomes excessively large, this promotes carbon generated in fuel combustion in the combustion chamber to easily enter into the gap between the projection part 11*b* of the housing 11 and the first end E1 of the leg part 12*c* of the insulator 12. This reduces a magnitude of the insulation resistance between the housing 11 and the central electrode 13.

The experiment according to the present disclosure performed the evaluation test of the test samples and the comparative samples so as to obtain the optimum values regarding the first gap width s1, the first radial thickness t1 and the center radial thickness t2 of the leg part 11 in the spark plug 10.

FIG. 5 is a table showing the experimental results of the first gap width s1, the first radial thickness t1, the center radial thickness t2, a ratio t1/t2 and evaluation results of the test samples 6-8, 10-11, 13, 16 and 17 and the comparative samples 1-5, 9, 12, 14-15, 17 and 19.

The table shown in FIG. 5 represents the evaluation results of the experimental results regarding the first gap width s1, the first radial thickness t1, the center radial thickness t2, and the ratio t2/t1.

The experiment according to the exemplary embodiment prepared the test samples 6-8, 10-11, 13, 16 and 17 and the comparative samples 1-5, 9, 12, 14-15, 17 and 19 which have the first radial thickness t1 of a constant value of 1.71 mm, and the different first gap width s1 and the different center radial thickness t2.

The experiment performed the flash over resistance (F/O resistance) test of each of the test samples 6-8, 10-11, 13, 16 and 17 and the comparative samples 1-5, 9, 12, 14-15, 17 and 19 under the following conditions.

Each of the test samples was mounted to a pressure chamber so that a spark plug as each sample was arranged to be to perform a visual inspection. The experiment detected a frequency of occurrence of the flashover phenomenon in each sample under the conditions in which an applied pressure was 0.9 MPa and a supplied voltage was 30 kV at 30 Hz.

In the table shown in FIG. 5, reference character "A" represents that the test sample is Excellent when the frequency of occurrence of the flashover phenomenon is not larger than 0.1%, and reference character "B" represents that the test sample is Defective because the frequency of occurring a flashover phenomenon is larger than 0.1%.

The experiment performed the pollution resistance test of each test sample under the following conditions so as to detect the pollution resistance of each test sample.

Each test sample as the spark plug was mounted on a vehicle equipped with a 1.8 Litter four-cylinder engine. The engine was worked in a predetermined working pattern (1 cycle) determined according to JIS D_1606 (Japanese Industrial Standards D1606). After this, the experiment detected an insulation resistance of the test sample under the condition determined by JIS B_8031.

The experiment determined that the test sample is Excellent designated by reference character "A" (without insulation degradation) when this test sample has not less than 8 cycles when the detected insulation resistance of the test sample becomes below 10 MΩ.

On the other hand, the experiment determined that the test sample is Defective designated by reference character "B" (with insulation degradation) when this test sample has not larger than 7 cycles when the detected insulation resistance of the test sample becomes below 10 MΩ.

The experiment detected on the basis of the experimental results that the test sample has the evaluation result "B" when the test sample has the first gap width s1 of 0.55 mm. On the other hand, the experiment evaluated on the basis of the experimental results that the test sample has the evaluation result "A" when the test sample has the first gap width s1 of not larger than 0.50 mm. That is, when the first gap width s1 exceeds 0.50 mm, carbon generated by the fuel combustion easily enters into the inside of the gap formed between the projection part 11*b* of the housing 11 and the first end E1 of the leg part 12*c* of the insulator 12. This reduces the insulation resistance between the housing 11 and the central electrode 13.

On the other hand, when the first gap width s1 is not larger than 0.50 mm, it is possible to prevent carbon generated by the fuel combustion easily from entering into the inside of the gap formed between the projection part 11*b* of the housing 11 and the first end E1 of the leg part 12*c* of the insulator 12.

The experiment evaluated the idling operation stability and the acceleration stability of each test sample during the pollution resistance test under the condition in which each test sample was mounted onto the vehicle equipped with the 1.8 Litter four-cylinder engine (as previously described).

The experiment determined that the test sample is Excellent designated by reference character "A" (without deterioration) when the total number of cycles until the occurrence of abnormality is not less than eight (≥8).

On the other hand, the experiment determined that the test sample is Defective designated by reference character "B" (with deterioration) when the total number of cycles until the occurrence of abnormality is not larger than seven (≤7).

The experiment evaluated on the basis of the experimental results that the test sample has the evaluation result "B" when the test sample has the ratio t2/t1 of 0.9. On the other hand, the experiment evaluated on the basis of the experimental results that the test sample has the evaluation result "A" when the test sample has the ratio t2/t1 of not larger than 0.85. That is, the center radial thickness t2 of the leg part 11 becomes thick according to the increase of the ratio t2/t1 because the first radius thickness t1 has a constant value. The thicker the center radial thickness t2 of the leg part 11 becomes, the more the spark discharge between the housing 11 and the central electrode 13 easily occurs, and the more the ignitability of a fuel mixture gas in the combustion chamber of an internal combustion engine reduces.

On the other hand, the center radial thickness t2 of the leg part 11 becomes thin when the ratio t2/t1 is not larger than 0.85. This prevents the spark discharge between the housing 11 and the central electrode 13 form easily occurring.

Figure 6:
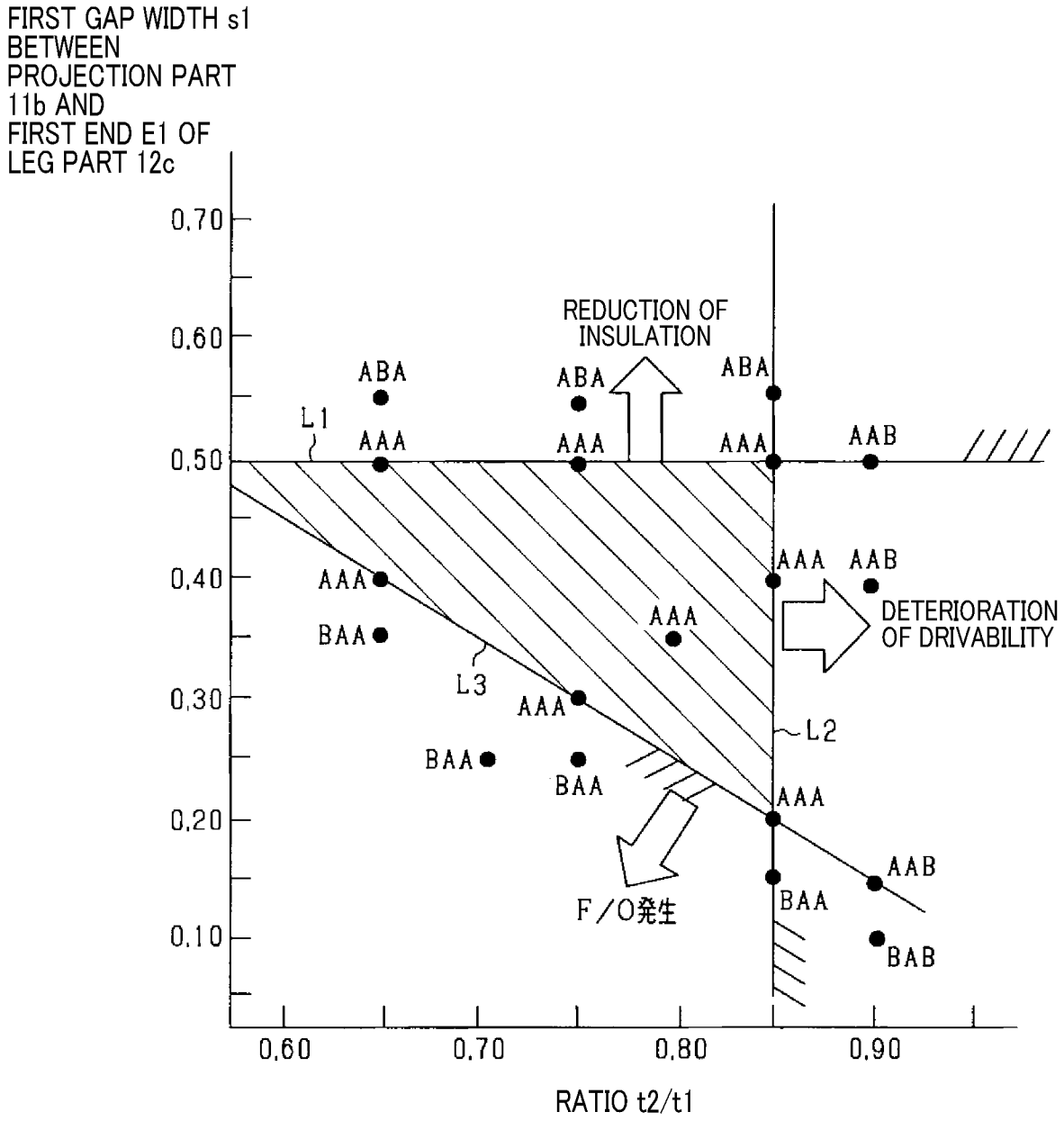
FIG. 6 is a graph showing a relationship between the ratio t2/t1, the first radial thickness t1 of the leg part 12*c* of the insulator 12 and the evaluation results of the test samples and the comparative samples.

FIG. 6 is a graph showing a relationship between the ratio t2/t1, the first radial thickness t1 of the leg part 12*c* of the insulator 12 and the evaluation results of the test samples and the comparative samples. That is, FIG. 6 shows the evaluation results regarding the F/O resistance, the pollution resistance and the drivability of the test samples and the comparative samples. In the graph regarding the evaluation results shown in FIG. 6, for example, the reference symbol "ABA" represents in order the evaluation result of the F/O resistance, the pollution resistance and the drivability, in which a test sample has an excellent F/O resistance designated by reference character "A", a defective pollution resistance designated by reference character "B", and an excellent drivability designated by reference character "A".

As shown in FIG. 6, the drivability is deteriorated, i.e. reduced when being designated by reference character "B" (Defective) in the right-hand side area from a straight line L2. This straight line L2 indicates the ratio t2/t1 of 0.85 (t2/t1=0.85). On the other hand, the drivability is improved, i.e. has the evaluation "A" (Excellent) in the left-hand side area from the straight line L2.

As shown in FIG. 6, the pollution resistance is deteriorated, i.e. reduced because of being designated by reference character "B" (Defective) in the upper area from a straight line L1.

This straight line L1 indicates the first gap width s of 0.50 (s1=0.50). On the other hand, the pollution resistance is improved, i.e. has the evaluation "A" (Excellent, without insulation reduction) on the straight line L2 and in the lower area from the straight line L2.

Further, as shown in FIG. 6, the F/O resistance is deteriorated, i.e. reduced because of being designated by reference character "B" (Defective) in the lower area from a straight line L3. This straight line L3 indicates s1=1.05−t2/t1. On the other hand, the F/O resistance is improved, i.e. has the evaluation "A" (Excellent) on the straight line L3 and in the upper area from the straight line L3.

That is, in the specific areas, designated by the oblique lines (hatching) shown in FIG. 6, i.e. the areas indicated by t2/t1≤0.85, s1 ≤0.5, and s1≥1.05−t2/t1, each of the test samples has Excellent designated by the reference character "A" regarding each of the drivability, the pollution resistance and the F/O resistance.

On the basis of the experimental results and the evaluation results, the spark plug 10 according to the exemplary embodiment has the improved structure in which the center radial thickness t2 of the leg part 12*c* of the insulator 12 and the projection length of the projection part 11*b* of the insulator 12 satisfies the relationship of t1=1.71 mm, t2/t1≤0.85, s1≤0.5, and s1≥1.05−t2/t1.

Further, the spark plug 10 according to the exemplary embodiment has the improved structure in which the leg part 12*c* has the leg length L of 8 mm. This structure makes it possible to obtain the same evaluation results previously described. That is, the spark plug 10 according to the exemplary embodiment has the improved structure in which the length between the first end E1 and the second end E2 of the leg part 12*c* in the axial direction of the insulator 12 is not less than 8 mm, and not larger than 14 mm.

Effects

A description will now be given of the following effects of the spark plug 10 according to the exemplary embodiment.

The spark plug 10 according to the exemplary embodiment of the present disclosure has the improved structure which satisfies the relationship of t2/t1≤0.85. This structure makes it possible to suppress discharge from occurring between the housing 11 and the central electrode 13 due to accumulated carbon. Further, this structure makes it possible to suppress the reduction of ignitability of a fuel mixture gas in the combustion chamber of an internal combustion engine.

Further, the spark plug 10 according to the exemplary embodiment of the present disclosure has the improved structure which satisfies the relationship of s1≤0.5. This structure makes it possible to prevent carbon generated during fuel combustion of a fuel mixture gas in the combustion chamber from entering into the gap between the projection part 11*b* of the housing 11 and the first end E1 of the leg part 12 of the insulator 12. This structure makes it possible to suppress the insulation resistance between the housing 11 and the central electrode 13 from being reduced.

Still further, the spark plug 10 according to the exemplary embodiment of the present disclosure has the improved structure which satisfies the relationship of s1≥1.05−t2/t1. This structure makes it possible to prevent a flashover phenomenon from occurring. As previously described, the spark plug 10 according to the exemplary embodiment of the present disclosure has the improved and superior ignitability As previously described in detail, the spark plug 10 according to the exemplary embodiment of the present disclosure has the specific parameters regarding the first radial thickness t1 and the center radial thickness t2 of the leg part 12*c* of the insulator 12, the ratio t1/t2, the first gap width s1, the second gap width s2, the third gap width s3, and others. This improved structure makes it possible to suppress the reduction of the productivity of the spark plug without performing precise adjustment of roughness of the outer surface of the insulator 12.

Still further, the spark plug 10 according to the exemplary embodiment has the improved structure in which the gap in the radial direction between the housing 11 and the middle position in the axial direction of the leg part 12*c* has the second gap width s2 (mm), and the gap in the radial direction between the housing 11 and the second end E2 of the leg part 12*c* has the third gap width s3 (mm). The spark plug 10 according to the exemplary embodiment satisfies the specific relationship of s1<s2<s3. Although the first gap width s1 is reduced due to the formation of the projection part 11*b*, this structure makes it possible to increase the second gap width s2 and the third gap width s3 to be larger than first gap width s1. This structure makes it possible to suppress ionization of a fuel mixture gas from occurring in a gap between the housing 11 and the middle position of the leg part 12*c*, the gap between the housing 11 and the second end E2 of the leg part 12*c*. This makes it possible to suppress a streamer discharge phenomenon and a flashover phenomenon from occurring.

Further, when the spark plug 10 according to the exemplary embodiment has the improved structure in which the length of the first end E1 to the second end E2 measured in the axial direction of the leg part 12*c* of the insulator 12 is not less than 8 mm and not larger than 14 mm, this structure makes it possible to improve the ignitability of the spark plug 10.

For example, the smaller the inner diameter of the housing which faces the leg part 12*c* of the insulator 12 is, the more it becomes difficult to have the width between the projection part 11*b* of the housing 11 and the leg part 12*c* of the insulator. That is, it becomes difficult to suppress a flashover phenomenon from occurring in the gap formed between the housing 11 and the leg part 12*c* of the insulator 12.

On the other hand, the spark plug 10 according to the exemplary embodiment has the improved structure in which the housing 11 except for the projection part 11*b*, which faces the leg part 12 of the insulator 12, has the inner diameter of 6.0 mm. This structure of the spark plug 10 makes it possible to suppress a flashover phenomenon from occurring in the gap between the housing 11 and the insulator 12.

In general, the smaller, the outer diameter of the screw part 11*a* formed on the outer peripheral surface of the housing 11, the more it becomes difficult to increase the inner diameter of the housing 11, which faces the leg part 12*c*. It becomes difficult to maintain the width in the radial direction between the projection part 11*b* of the housing 11 and the leg part 12*c* suppress. Further, it becomes difficult to suppress a flashover phenomenon from occurring in the gap between the housing 11 and the leg part 12*c* of the insulator 12.

On the other hand, the spark plug 10 according to the exemplary embodiment has the improved structure in which the screw part 11*a* is formed on the outer peripheral surface of the housing 11, and the screw part 11*a* has the outer diameter of 10 mm. This improved structure makes it possible to suppress the flashover phenomenon from occurring in the gap between the housing 11 and the leg part 12*c* of the insulator 12.

The concept of the present disclosure is not limited by the exemplary embodiment previously described. It is possible for the spark plug 10 according to the present disclosure to have various modifications. In the following description, the same components between the modifications and the exemplary embodiment will be referred to as the same reference numbers and characters. The explanation of the same components will be omitted from brevity.

In a modification, it is possible to form a noble metal chip on each of the distal end surface 13*a* of the central electrode 13 and the distal end part 14*a* of the ground electrode 14. It is preferable to form the noble metal chip made of IrRh alloy, which is an Ir (Iridium) based alloy including rhodium (Rh).

Further, in a modification, it is possible for the screw part 11 to have the outer diameter which is less than or larger than 10 mm.

Further, in a modification, it is possible for the leg part 12*c* to have the inner diameter d2 of not less than 1.5 mm and not larger than 2.0 mm, instead of 1.75 mm. This structure makes it possible to have the same effects of the spark plug 10 according to the exemplary embodiment.

Further, in a modification, it is possible for the leg part 12*c* to have the projection length, in the axial direction of the of the leg part 12*c*, which projects from the housing, of not less than 1.3 mm and not larger than 1.8 mm, instead of 1.5 mm. This structure makes it possible to have the same effects of the spark plug 10 according to the exemplary embodiment.

Further, in a modification, it is acceptable for the part of the housing 11, which faces the leg part 12*c* of the insulator 12, to have the inner diameter d1 of not less than 5.8 mm and not larger than 6.2 mm instead of 6.0 mm. This structure makes it possible to have the same effects of the spark plug 10 according to the exemplary embodiment.

Further, in a modification, it is acceptable for the area from the first end E1 to the second end E2 in the axial direction of the leg part 12*c* to have a length within a range of not less than 6 mm to 16 mm. This structure makes it possible to have the same effects of the spark plug 10 according to the exemplary embodiment.

Still further, in a modification, it is acceptable for the spark plug 10 according to the present disclosure to satisfy the relationship of s1<s2=s3 instead of s1<s2<s3. This structure also makes it possible to have the same effects of the spark plug 10 according to the exemplary embodiment.

In summary, the spark plug according to the exemplary embodiment has the following improved structure. The metal fitting as a housing has a cylindrical shape. The metal fitting has the projection part which projects radially toward the insulator side. The insulator also has the cylindrical shape and is inserted into and fixed to the inside of the metal fitting so as to be coaxially arranged in the inside of the metal fitting. The insulator has a first body part, a second body part and a leg part. The first body part has a first outer diameter which is greater than an inner diameter of the projection part. The step part has a ring shape and is formed between the second body part and the leg part. A gap formed between the step part of the insulator and the projection part of the metal fitting is sealed with the packing of a ring shape. The central electrode projects from the inside of the insulator toward the ground electrode. The ground electrode is joined to the metal fitting. That is, the ground electrode projects in the axial direction of the spark plug from the metal fitting, and is curved to face the central electrode. This allows a spark gap to be formed between the two electrodes. When a predetermined voltage is supplied between the central electrode and the ground electrode, spark discharge occurs in the spark gap. This ignites a fuel mixture gas composed of air and fuel.

The leg part has the first end and the second end in the axial direction of the leg part. The first end of the leg part is located at the end of the second body part of the insulator. The first end in a radial direction of the leg part has the first radial thickness t1 (mm). The middle part between the first end and the second end of the leg part has the center radial thickness t2 (mm). The gap, between the projection part of the metal fitting and the first end of the leg part in the radial direction of the metal fitting, has the first gap width s1 (mm).

The inventors of the present disclosure have recognized the following phenomenon. Under a condition in which the first radial thickness t1 is a constant value, the outer diameter of the leg part increases when the ratio t2/t1 becomes larger than 0.85. When carbon is accumulated on the surface of the insulator, this structure allows a spark discharge to easily occur between the metal fitting and the central electrode due to the presence of the accumulated carbon. This reduces the ignitability of a fuel mixture gas in the combustion chamber of an internal combustion engine.

Further, the inventors of the present disclosure have recognized the following phenomenon.

When the first gap width s1 of the gap between the projection part of the metal fitting and the first end of the leg part in the radial direction of the metal fitting exceeds 0.5 mm, carbon generated during fuel combustion easily enters into the gap between the projection part of the metal fitting and the first end of the leg part during the fuel combustion. This reduces an insulation resistance between the metal fitting and the central electrode.

Further, the inventors of the present disclosure have recognized the following matters.

The shorter the first gap width s1 is, the stronger an electrical field strength between the projection part and the first end of the leg part becomes. This easily promote ionization of a fuel mixture gas in a combustion chamber. Ionization of the fuel mixture gas allows a streamer discharge phenomenon (as filamentary discharge) to easily occur.

In particular, when the ratio t2/t1 has a small value, streamer discharge phenomenon easily occurs because an electrostatic capacitance of the area of the first end to the middle part of the leg part increases. The structure of the spark plug which satisfies the relationship of $s1<1.05-t2/t1$ allows a flashover phenomenon (which is discharging along a surface of the insulator) to easily occur.

The structure of the spark plug satisfying the relationship of $t2/t1\leq 0.85$ makes it possible to suppress discharge from occurring between the metal fitting and the central electrode due to accumulated carbon. This structure makes it possible to suppress the reduction of ignitability of a fuel mixture gas in the combustion chamber of an internal combustion engine.

Further, the structure of the spark plug satisfying the relationship of $s1\leq 0.5$ makes it possible to prevent carbon generated during fuel combustion of a fuel mixture gas from entering into the gap between the projection part of the metal fitting and the first end of the leg part. This structure makes it possible to suppress the insulation resistance between the metal fitting and the central electrode from being reduced.

Still further, the structure of the spark plug satisfying the relationship of $s1\geq 1.05-t2/t1$ makes it possible to prevent flashover phenomenon from occurring. As previously described, the spark plug according to the present disclosure has the improved and superior ignitability.

The spark plug according to the present disclosure having the specific parameters previously described makes it possible to increase its ignitability. This improved structure of the spark plug makes it possible to suppress the reduction of the productivity of the spark plug without performing precise adjustment of roughness of the outer surface of the insulator.

The shorter the width between the metal fitting and the leg part of the insulator becomes, the stronger the electrical field strength between the metal fitting and the leg part becomes. This allows a fuel mixture gas in the gap between the metal fitting and the leg part to be easily ionized. The ionized fuel mixture gas easily causes a streamer discharge phenomenon in this gap.

In accordance with a second aspect of the present disclosure, there is provided a spark plug which satisfies a relationship of $s1<s2<s3$, where s2 represents a second gap width of a gap in the radial direction between the metal fitting and the middle position in the axial direction of the leg part, and s3 represents a third gap width of a gap in the radial direction between the metal fitting and the second end of the leg part.

This structure makes it possible to lengthen the second gap width and the third gap width compared to the first gap width to be reduced due to the presence of the projection part of the metal fitting. This makes it possible to suppress the occurrence of ionization of a fuel mixture gas in the gap between the metal fitting and the middle part of the leg part and in the gap between the metal fitting and the second end of the leg part. This makes it possible to suppress a streamer discharge phenomenon and a flashover phenomenon from occurring.

In accordance with a third aspect of the present disclosure, there is provided a spark plug which satisfies a relationship in which the length measured between the first end and the second end in the axial direction of the leg part is not less than 8 mm and not larger than 14 mm. This improved structure makes it possible to improve the ignitability of the spark plug when the relationship determined in the first aspect of the present disclosure is also satisfied.

For example, the smaller the inner diameter of the metal fitting which faces the leg part of the insulator is, the more it becomes difficult to have the width between the projection part and the leg part. It becomes difficult to suppress a flashover phenomenon from occurring in the gap formed between the metal fitting and the leg part.

In accordance with a fourth aspect of the present disclosure, there is provided a spark plug which satisfies a relationship in which an area of the metal fitting except for the projection part, which faces the leg part, has an inner diameter of not less than 5.8 mm and not larger than 6.2 mm. This structure makes it possible to suppress a flashover phenomenon from occurring.

In accordance with a fifth aspect of the present disclosure, there is provided a spark plug satisfying a relationship in which the leg part has the inner diameter of not less than 1.5 mm and not larger than 2.0 mm.

In accordance with a sixth aspect of the present disclosure, there is provided a spark plug in which the leg part projecting from the metal fitting has a length in the axial direction of the insulator of not less than 1.3 mm and not larger than 1.8 mm.

In general, the smaller the outer diameter of the screw part formed on the outer peripheral surface of the metal fitting, the more it becomes difficult to increase the inner diameter of the metal fitting, which faces the leg part. It also becomes difficult to maintain the width in the radial direction between the projection part and the leg part. It becomes further difficult to suppress a flashover phenomenon from occurring in the gap between the metal fitting and the leg part of the insulator.

In accordance with a seventh aspect of the present disclosure, there is provided a spark plug in which a screw part is formed on an outer peripheral part of the metal fitting, and the screw part has an outer diameter of 10 mm. This improved structure makes it possible to suppress a flashover phenomenon from occurring.

While specific embodiments of the present disclosure have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present disclosure which is to be given the full breadth of the following claims and all equivalents thereof.

What is claimed is:

1. A spark plug comprising:

a metal fitting of a cylindrical shape, the metal fitting comprising a projection part of a ring shape and projecting radially;

an insulator of a cylindrical shape inserted into and fitted to an inside of the metal fitting, the insulator comprising a first body part, a second body part and a leg part, the second body part having a second outer diameter greater than an inner diameter of the projection part, the first body part having a first outer diameter greater than the second outer diameter of the second body part, the leg part having a third outer diameter smaller than the inner diameter of the projection part;

a packing with which a gap formed between a step part and the leg part is sealed, the step part being formed between the second body part and the leg part of the insulator;

a central electrode projecting from an inside of the insulator; and a ground electrode joined to the metal fitting and having an extension part, a curved part and a flat part, the extension part joined to the flat part through the curved part to face a distal end surface of the central electrode, wherein the spark plug satisfies a relationship of $t2/t1 \leq 0.85$, and $s1 \leq 0.5$, and $s1 \geq 1.05 - t2/t1$, where the leg part has a first end and a second end in the axial direction of the leg part, the first end of the leg part is located at the end of the second body part of the insulator, the second end is located opposite to the first end in the axial direction of the leg part, t1 represents a first radial thickness of the first end, t2 represents a center radial thickness in the radial direction of the leg part at a middle position between the first end and the second end, and s1 represents a first gap width of a gap between the projection part of the metal fitting and the first end of the leg part in a radial direction of the metal fitting.

2. The spark plug according to claim 1, wherein the spark plug satisfies a relationship of $s1<s2<s3$, where s2 represents a second gap width of a gap in the radial direction between the metal fitting and the middle position in the axial direction of the leg part, and s3 represents a third gap width of a gap in the radial direction between the metal fitting and the second end E2 of the leg part.

3. The spark plug according to claim 1, wherein the spark plug satisfies a relationship in which a length measured between the first end and the second end in the axial direction of the leg part is not less than 8 mm and not larger than 14 mm.

4. The spark plug according to claim 2, wherein the spark plug satisfies a relationship in which a length measured between the first end and the second end in the axial direction of the leg part is not less than 8 mm and not larger than 14 mm.

5. The spark plug according to claim 1, wherein the spark plug satisfies a relationship in which an area of the metal fitting except for the projection part, which faces the leg part, has an inner diameter of not less than 5.8 mm and not larger than 6.2 mm.

6. The spark plug according to claim 2, wherein the spark plug satisfies a relationship in which an area of the metal fitting except for the projection part, which faces the leg part, has an inner diameter of not less than 5.8 mm and not larger than 6.2 mm.

7. The spark plug according to claim 3, wherein the spark plug satisfies a relationship in which an area of the metal fitting except for the projection part, which faces the leg part, has an inner diameter of not less than 5.8 mm and not larger than 6.2 mm.

8. The spark plug according to claim 4, wherein the spark plug satisfies a relationship in which an area of the metal fitting except for the projection part, which faces the leg part, has an inner diameter of not less than 5.8 mm and not larger than 6.2 mm.

9. The spark plug according to claim 1, wherein the spark plug satisfies a relationship in which the leg part has an inner diameter of not less than 1.5 mm and not larger than 2.0 mm.

10. The spark plug according to claim 2, wherein the spark plug satisfies a relationship in which the leg part has an inner diameter of not less than 1.5 mm and not larger than 2.0 mm.

11. The spark plug according to claim 3, wherein the spark plug satisfies a relationship in which the leg part has an inner diameter of not less than 1.5 mm and not larger than 2.0 mm.

12. The spark plug according to claim 4, wherein the spark plug satisfies a relationship in which the leg part has an inner diameter of not less than 1.5 mm and not larger than 2.0 mm.

13. The spark plug according to claim 1, wherein the leg part projecting from the metal fitting in the axial direction of the insulator has a length of not less than 1.3 mm and not larger than 1.8 mm.

14. The spark plug according to claim 2, wherein the leg part projecting from the metal fitting in the axial direction of the insulator has a length of not less than 1.3 mm and not larger than 1.8 mm.

15. The spark plug according to claim 3, wherein the leg part projecting from the metal fitting in the axial direction of the insulator has a length of not less than 1.3 mm and not larger than 1.8 mm.

16. The spark plug according to claim 4, wherein the leg part projecting from the metal fitting in the axial direction of the insulator has a length of not less than 1.3 mm and not larger than 1.8 mm.

17. The spark plug according to claim 1, wherein a screw part is formed on an outer peripheral part of the metal fitting, and the screw part has an outer diameter of 10 mm.

18. The spark plug according to claim 2, wherein a screw part is formed on an outer peripheral part of the metal fitting, and the screw part has an outer diameter of 10 mm.

19. The spark plug according to claim 3, wherein a screw part is formed on an outer peripheral part of the metal fitting, and the screw part has an outer diameter of 10 mm.

20. The spark plug according to claim 4, wherein a screw part is formed on an outer peripheral part of the metal fitting, and the screw part has an outer diameter of 10 mm.

* * * * *